US008346122B2

(12) United States Patent
Watanabe

(10) Patent No.: US 8,346,122 B2
(45) Date of Patent: Jan. 1, 2013

(54) IMAGE FORMING DEVICE INCLUDING LOCK MEMBER THAT LOCKS COVER MEMBER WITH RESPECT TO CASING

(75) Inventor: Yasunori Watanabe, Nagoya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 334 days.

(21) Appl. No.: 12/622,909

(22) Filed: Nov. 20, 2009

(65) Prior Publication Data

US 2010/0158560 A1 Jun. 24, 2010

(30) Foreign Application Priority Data

Dec. 24, 2008 (JP) ..... 2008-327338

(51) Int. Cl.
*G03G 15/00* (2006.01)

(52) U.S. Cl. ..... 399/110

(58) Field of Classification Search ..... 399/110, 399/124, 125

See application file for complete search history.

(56) References Cited

U.S. PATENT DOCUMENTS

| | | | | |
|---|---|---|---|---|
| 7,341,387 | B2 | 3/2008 | Nishimura et al. | |
| 8,154,770 | B2 * | 4/2012 | Shiraki et al. | 358/401 |
| 2005/0196217 | A1 | 9/2005 | Nishimura et al. | |
| 2008/0145098 | A1 | 6/2008 | Ito | |

FOREIGN PATENT DOCUMENTS

| | | | | |
|---|---|---|---|---|
| JP | 62-043360 | S | | 3/1987 |
| JP | 3-063666 | A | | 3/1991 |
| JP | 07-026852 | U | | 5/1995 |
| JP | 08-006466 | A | | 1/1996 |
| JP | 10-031405 | A | | 2/1998 |
| JP | 2000-079739 | A | | 3/2000 |
| JP | 2004-032280 | A | | 1/2004 |
| JP | 2005-252998 | A | | 9/2005 |
| JP | 2005-258025 | | | 9/2005 |
| JP | 2005252998 | A | * | 9/2005 |
| JP | 2005-301154 | A | | 10/2005 |
| JP | 2006-042003 | | | 2/2006 |
| JP | 2007-328302 | A | | 12/2007 |
| JP | 2008-134301 | A | | 6/2008 |
| JP | 2008-152122 | A | | 7/2008 |
| JP | 2008-209823 | | | 9/2008 |
| JP | 2008-292545 | A | | 12/2008 |
| JP | 2008292545 | A | * | 12/2008 |

OTHER PUBLICATIONS

Machine translation of Hayashi (JP,2008-292545,A). Pub. date: Dec. 4, 2008.*

JP Office Action dtd Nov. 24, 2010, JP Appln. 2008-327338, English translation.

JP Office Action dtd Mar. 8, 2011, JP Appln. 2008-327338, English translation.

JP Decision to Grant dated Aug. 30, 2011, corresponding Application No. 2008-327338; English Translation.

* cited by examiner

*Primary Examiner* — Walter L Lindsay, Jr.
*Assistant Examiner* — Frederick Wenderoth
(74) *Attorney, Agent, or Firm* — Banner & Witcoff, Ltd.

(57) ABSTRACT

An image forming device includes a casing, a cover member pivotable with respect to the casing between an open position and a closed position, a lock member that selectively locks and unlocks the cover member in the closed position, and a knob movable from an original position toward the open position of the cover member. The lock member is moved to an unlocking position as the knob is moved from the original position toward the open position.

16 Claims, 14 Drawing Sheets

IMAGE FORMING DEVICE INCLUDING LOCK MEMBER THAT LOCKS COVER MEMBER WITH RESPECT TO CASING

CROSS REFERENCE TO RELATED APPLICATION

This application claims priority from Japanese Patent Application No. 2008-327338 filed Dec. 24, 2008. The entire content of this priority application is incorporated herein by reference.

TECHNICAL FIELD

The present invention relates to an image forming device including a lock member that locks a cover member with respect to a casing.

BACKGROUND

There has been proposed an image forming device including a printer section and a scanner section disposed on the printer section. A discharged-sheet receiving space is defined between the printer section and the scanner section, and a maintenance cover at the top of the printer section is located in the discharged-sheet receiving space. When the scanner section is open, the maintenance cover is exposed. Opening the maintenance cover exposes an opening through which a user can perform various maintenance operations on components in the printer section for, for example, replacing of cartridges, clearing paper jam, or the like.

SUMMARY

It is an object of the invention to provide an image forming device with increased operability in relation to opening or closing of a maintenance cover.

In order to attain the above and other objects, the invention provides an image forming device including a casing, an image forming section, a cover member, a lock member, and a knob. The casing is formed with an opening on a top side, and the image forming section is disposed within the casing. The cover member has a first side and a second side opposite from the first side, and is pivotable with respect to the casing about the first side between an open position and a closed position for selectively opening and closing the opening. The first side is in an upperstream side of the second side with respect to a first direction in which a recording medium is discharged from the casing. The lock member is movable between a locking position and an unlocking position to selectively lock and unlock the cover member in the closed position. The lock member in the locking position locks the cover member in the closed position. The knob is provided to the cover member near the second side, enabling a user to hold the knob to move the cover member between the open position and the closed position. The knob is movable from an original position toward the open position of the cover member. The lock member is moved to the unlocking position as the knob is moved from the original position toward the open position.

According to another aspect, the present invention provides an image forming device including a casing, an image forming section, a cover member, a lock member, and a knob. The casing is formed with an opening on a top side, and the image forming section is disposed within the casing. The cover member has a first side and a second side opposite from the first side, and is pivotable with respect to the casing about the first side between an open position and a closed position for selectively opening and closing the opening. The first side is in an upperstream side of the second side with respect to a first direction in which a recording medium is discharged from the casing. The lock member selectively locks and unlocks the cover member in the closed position. The knob is provided to the cover member near the second side, enabling a user to hold knob to move the cover member between the open position and the closed position. The knob is pivotable from an original position toward the open position of the cover member. A locking state of the lock member is released in association with a movement of the knob from the original position toward the open position of the cover member.

BRIEF DESCRIPTION OF THE DRAWINGS

The particular features and advantages of the invention as well as other objects will become apparent from the following description taken in connection with the accompanying drawings, in which.

DETAILED DESCRIPTION

Figure 1:
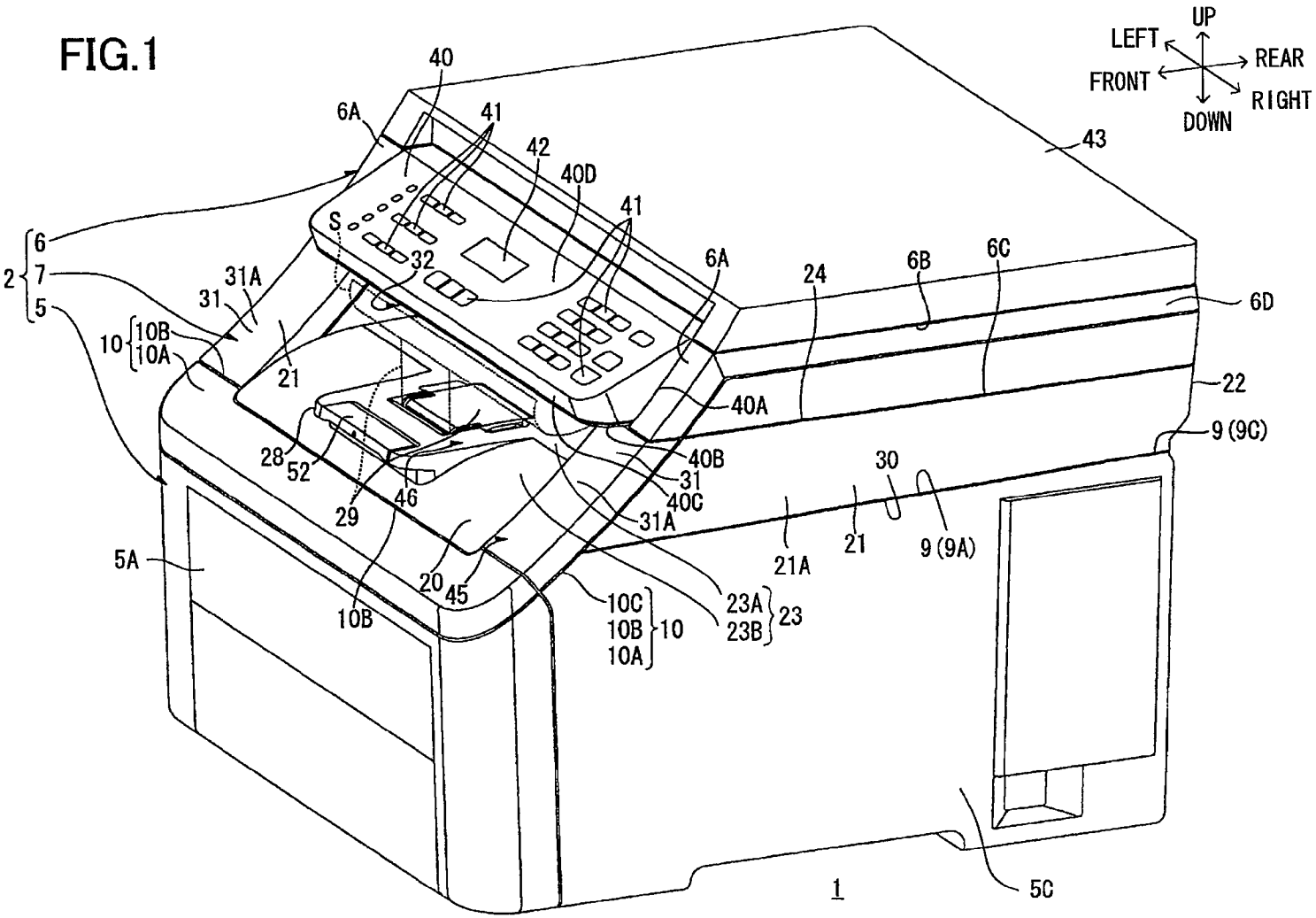
FIG. 1 is a perspective view of a printer according to an embodiment of the present invention with a middle body and an upper body both closed.

An image forming device according to an embodiment of the invention will be described while referring to the accompanying drawings wherein like parts and components are designated by the same reference numerals to avoid duplicating description. The embodiment pertains to a printer 1 shown in FIG. 1.

The terms "upward", "downward", "upper", "lower", "above", "below", "beneath", "right", "left", "front", "rear" and the like will be used throughout the description assuming that the printer 1 is disposed in an orientation in which it is intended to be used. It should be noted that a substantial horizontal direction includes both a width direction (left-toright direction) and a front-to-rear direction and that a substantial vertical direction includes an up-to-down direction. In use, the printer 1 is disposed as shown in FIG. 1.

Figure 4:
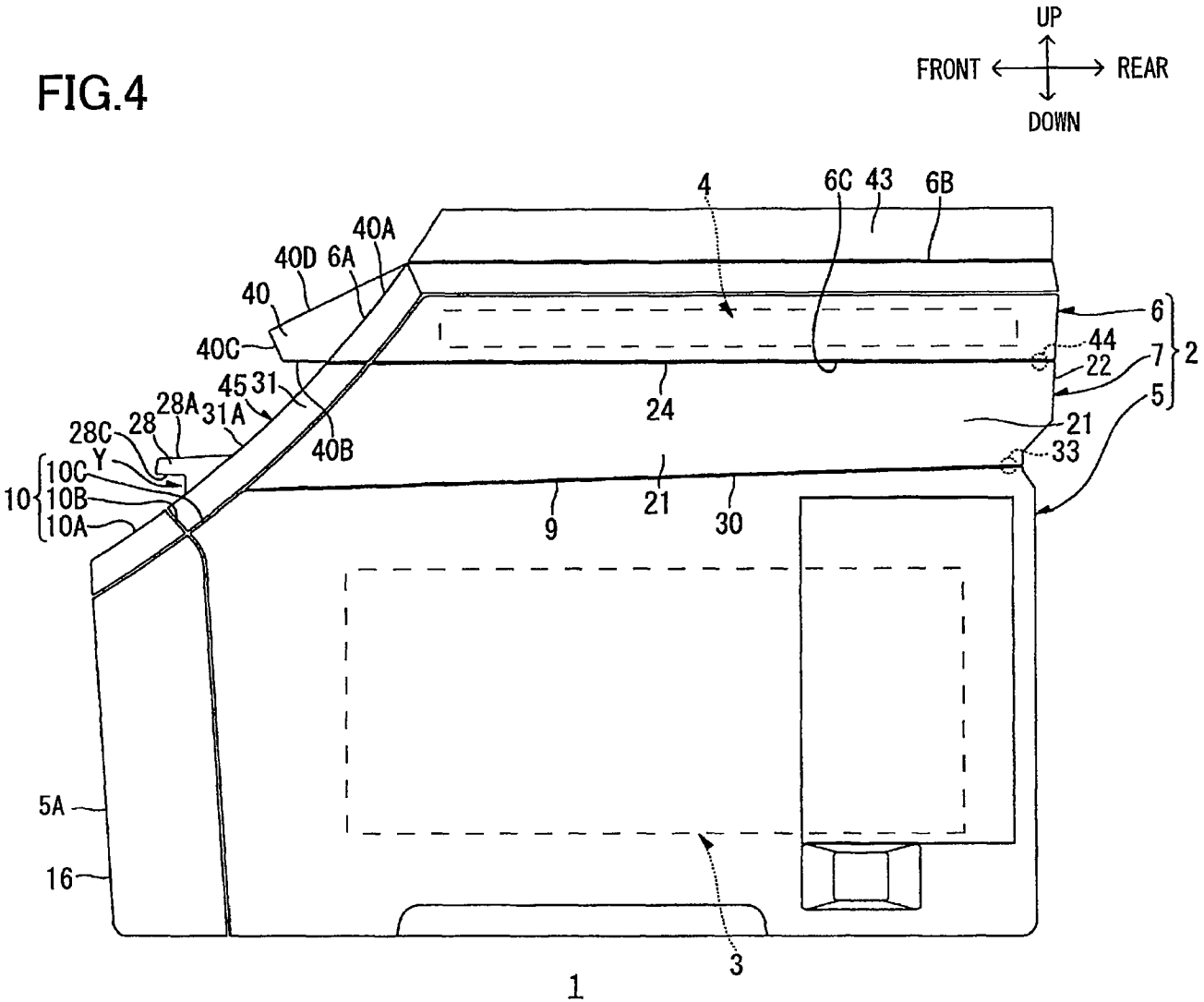
FIG. 4 is a right side view of the printer with the middle body and the upper body both closed.

As shown in FIG. 1, the printer 1 includes a casing 2 in a substantial cuboid shape with a dimension slightly greater in the front-to-rear direction than in the width direction. As shown in FIG. 4, a contour of the casing 2 in a right-side view is in a substantial rectangular shape with a sloping cutout at an upper front section, and the sloping cutout is defined by a sloping surface 45 that is slightly concavely curved. The printer 1 is a multifunction device including an image forming section 3 and an image reading section 4 to be described later.

The casing 2 includes a lower body 5, an upper body 6 disposed above the lower body 5, and a middle body 7 disposed between the lower body 5 and the upper body 6. The middle body 7 is pivotable to selectively open and close the top of the lower body 5 as shown in FIG. 2, and the upper body 6 is pivotable to selectively open and close the top of the middle body 7 as shown in FIG. 3.

Figure 2:
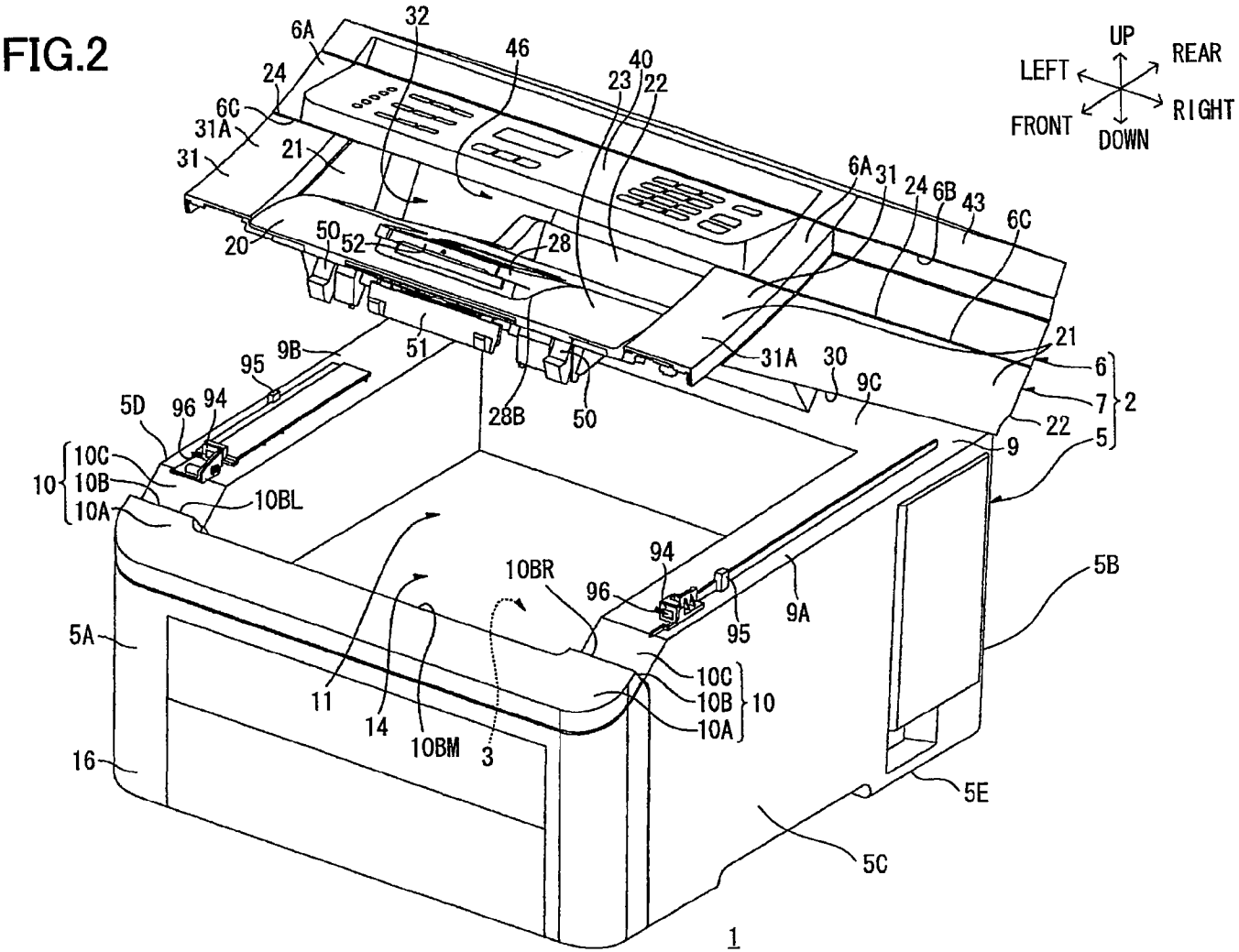
FIG. 2 is a perspective view of the printer with the middle body open.
Figure 3:
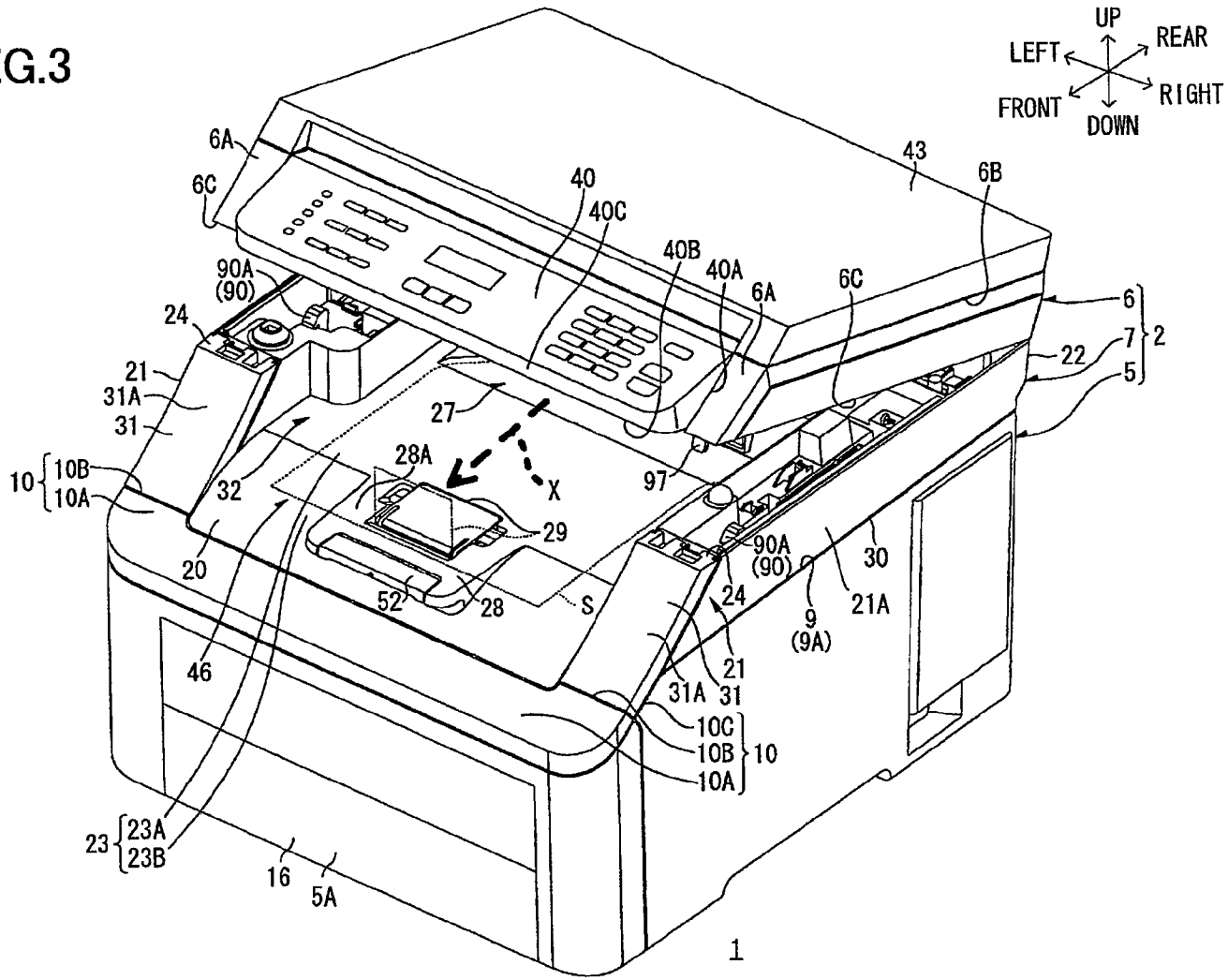
FIG. 3 is a perspective view of the printer with the upper body open.

As shown in FIG. 2, the lower body 5 is nearly in a hollow cuboid box-shape with a dimension greater in the front-to-rear direction than in the width direction and a relatively low height. The lower body 5 has a front surface 5A, a rear surface 5B, a right surface 5C, a left surface 5D, a bottom surface 5E, an upper surface 9, and a sloping surface 10. The front, rear, right, and left surfaces 5A, 5B, 5C, and 5D are all flat and extend in the substantial vertical direction, and the bottom and upper surfaces 5E and 9 are flat and extend in the substantial horizontal direction. The lower body 5 has rounded corners between the front surface 5A and the right surface 5C and between the front surface 5A and the left surface 5D.

The sloping surface 10 connects an upper end of the front surface 5A to a front end of the upper surface 9. The sloping surface 10 includes a first part 10A, a second part 10B, and a pair of third parts 10C arranged in this order in the front-to-rear direction. The first, second, and third parts 10A, 10B, and 10C are formed integrally with one another.

The first part 10A is connected to the upper end of the front surface 5A in the entire width. As shown in FIG. 4, the first part 10A is slightly concavely curved and extends in an upper rear direction. As shown in FIG. 2, the first part 10A has a substantial U-shape with an opening facing rearward.

The second part 10B is connected to a rear end of the first part 10A in the entire width and, as shown in FIG. 4, extends in a lower rear direction which is substantial orthogonal to the first part 10A. As shown in FIG. 2, the second part 10B has a right section 10BR, a left section 10BL, and a middle section 10BM between the right and left sections 10BR and 10BL in the width direction. The middle section 10BM is located further frontward than the right and left sections 10BR and 10BL. The third parts 10C are disposed with a space therebetween in the width direction, and each of the third parts 10C is connected to a rear end of either right or left section 10BR, 10BL of the second part 10B. As shown in FIG. 4, the third parts 10C extend in the upper rear direction which is substantial orthogonal to the second part 10B and substantial parallel to the first part 10A.

As shown in FIG. 2, the upper surface 9 is formed with an opening 11 in a rectangular shape in a plan view and includes a right part 9A, a left part 9B, and a rear part 9C. Front ends of the right part 9A and the left part 9B are connected to rear ends of the third parts 10C of the sloping surface 10. The opening 11 is defined by the right part 9A, the left part 9B, the rear part 9C, the second part 10B, and the third parts 10C.

The lower body 5 is formed therein with an accommodating chamber 14 in a substantial cuboid shape. The accommodating chamber 14 accommodates the image forming section 3 (FIG. 4) and is in fluid communication with the opening 11. The image forming section 3 includes expendables detachable therefrom, and such expendables can be replaced through the opening 11.

The image forming section 3 is, for example, for forming images on a print medium, such a paper sheet S shown in FIG. 3. The printer 1 may be any type of printer including a LED printer, a laser printer, and an inkjet printer, and may be a monochromatic printer or a color printer. The image forming section 3 has a configuration corresponding to the printer type.

As shown in FIG. 3, the middle body 7 integrally includes a cover member 20, a pair of support members 21, and a connecting member 22, together defining a space 32 therebetween at a position between the upper body 6 and the lower body 6.

The cover member 20 is in a substantial rectangular flat plate shape and has a dimension large enough to cover nearly the entire of the upper surface 9 of the lower body 5 shown in FIG. 2. When the middle body 7 is in the closed state, the cover member 20 closes the opening 11 and covers over the accommodating chamber 14. Thus, any foreign matter is prevented from entering the accommodating chamber 14 through the opening 11.

The cover member 20 has an upper surface 23. The support members 21 are arrayed in the width direction with the space 32 therebetween. Each support member 21 is in a hollow block shape with a dimension greater in the front-to-rear direction than in the width direction. The support members 21 are respectively connected to the right and left ends of the cover member 20 nearly in the entire areas in the front-to-rear direction. Each of the support members 21 has an upper surface 24 that is located at a higher position than the upper surface 23 of the cover member 20.

The connecting member 22 is in a block shape with a dimension greater in the width direction than in the front-to-rear direction. The connecting member 22 is connected to a rear end of the cover member 20 in the entire width, and connects between rear ends of the support members 21. Although not shown in the drawings, a top surface of the connecting member 22 is located at a higher position than the upper surface 23 of the cover member 20 and is substantial flush with the upper surfaces 24 of the support members 21.

The cover member 20 will be described further. The upper surface 23 of the cover member 20 includes a support surface 23A on the rear side and a sloping surface 23B on the front side.

The support surface 23A is flat and expands in the substantial horizontal direction. The support surface 23A is formed with a discharge port 27 at a rear section for discharging the paper sheet S therethrough. That is, the discharge port 27 has a dimension large enough to let the paper sheet S pass therethrough. The discharge port 27 penetrates through the cover member 20 in a thickness direction which is the vertical direction.

When the middle body 7 is in the closed state as shown in FIG. 3, the discharge port 27 is in fluid communication with the accommodating chamber 14 (FIG. 4) through the opening 11 from above. After an image is formed on the paper sheet S in the image forming section 3, the paper sheet S is discharged through the discharge port 27 in a discharge direction X into the space 32 and onto the support surface 23A. That is, the discharge direction X of the paper sheet S is a frontward direction in this embodiment. Thus, an upstream side in the discharge direction X is a rear side, and a downstream side in the discharge direction X is a front side.

Figure 6:
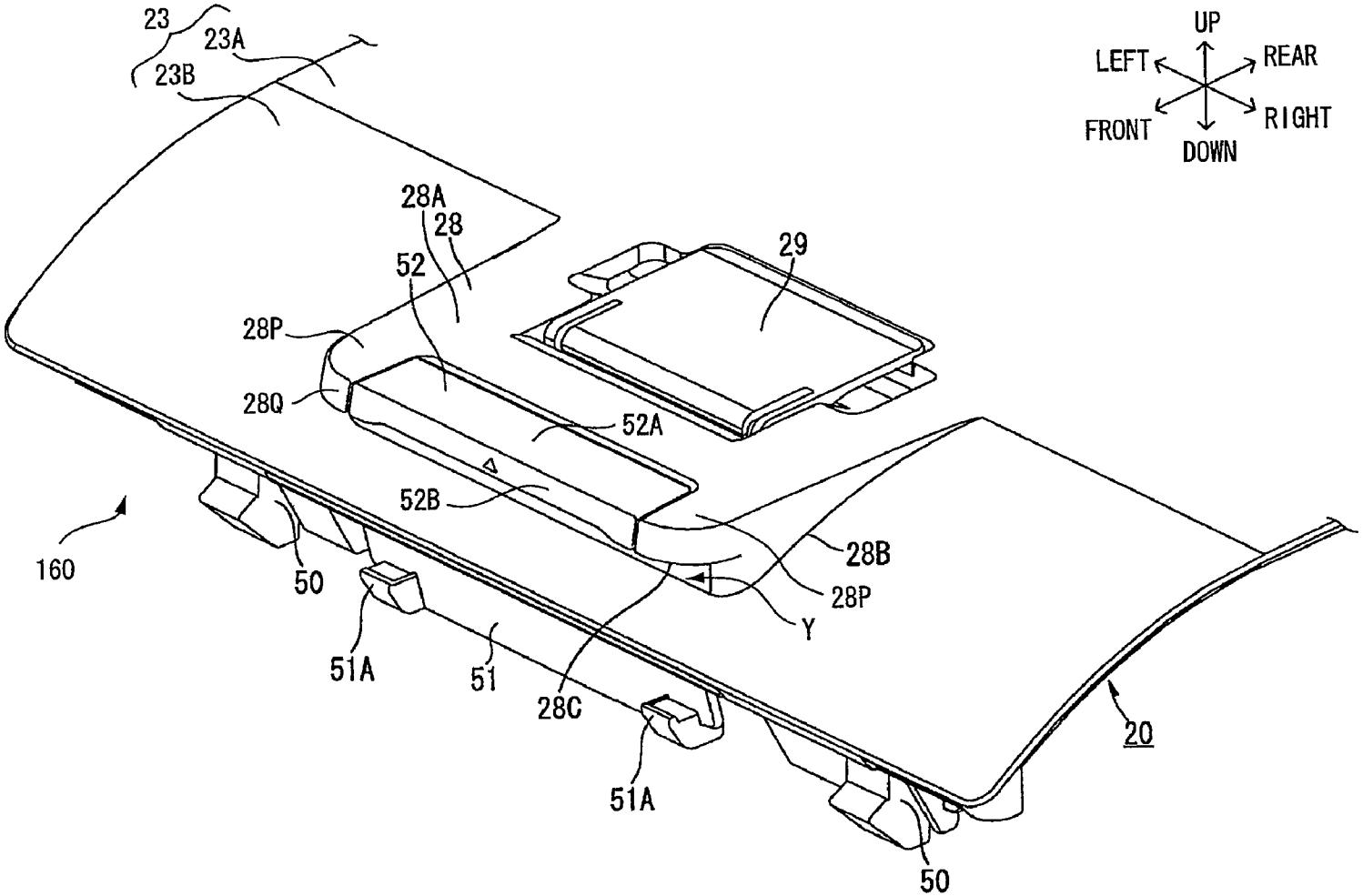
FIG. 6 is a perspective view showing a front section of a cover member of the middle body.

The sloping surface 23B is connected to the front of the support surface 23A in the lateral sections. As shown in FIG. 6, the sloping surface 23B is slightly convexly curved and slightly inclined from an upper rear side to a lower front side.

The cover member 20 is integrally formed with a grip member 28 at a position near the front in a widthwise center area. The grip member 28 is in a substantial plate shape with a relatively thin thickness in the vertical direction. The grip member 28 has a smaller width than a minimum width of the paper sheet S that can be used in the printer 1. The grip member 28 includes a knob 52 to be described later.

The grip member 28 protrudes frontward from a front end of the support surface 23A, and has an upper surface 28A continuous with the support surface 23A. Because the grip member 28 is in continuous with the support surface 23A for receiving a discharged paper sheet S, the grip member 28 does not interfere with sheet discharge, allowing smooth discharge of the paper sheet S onto the support surface 23A.

Figure 5:
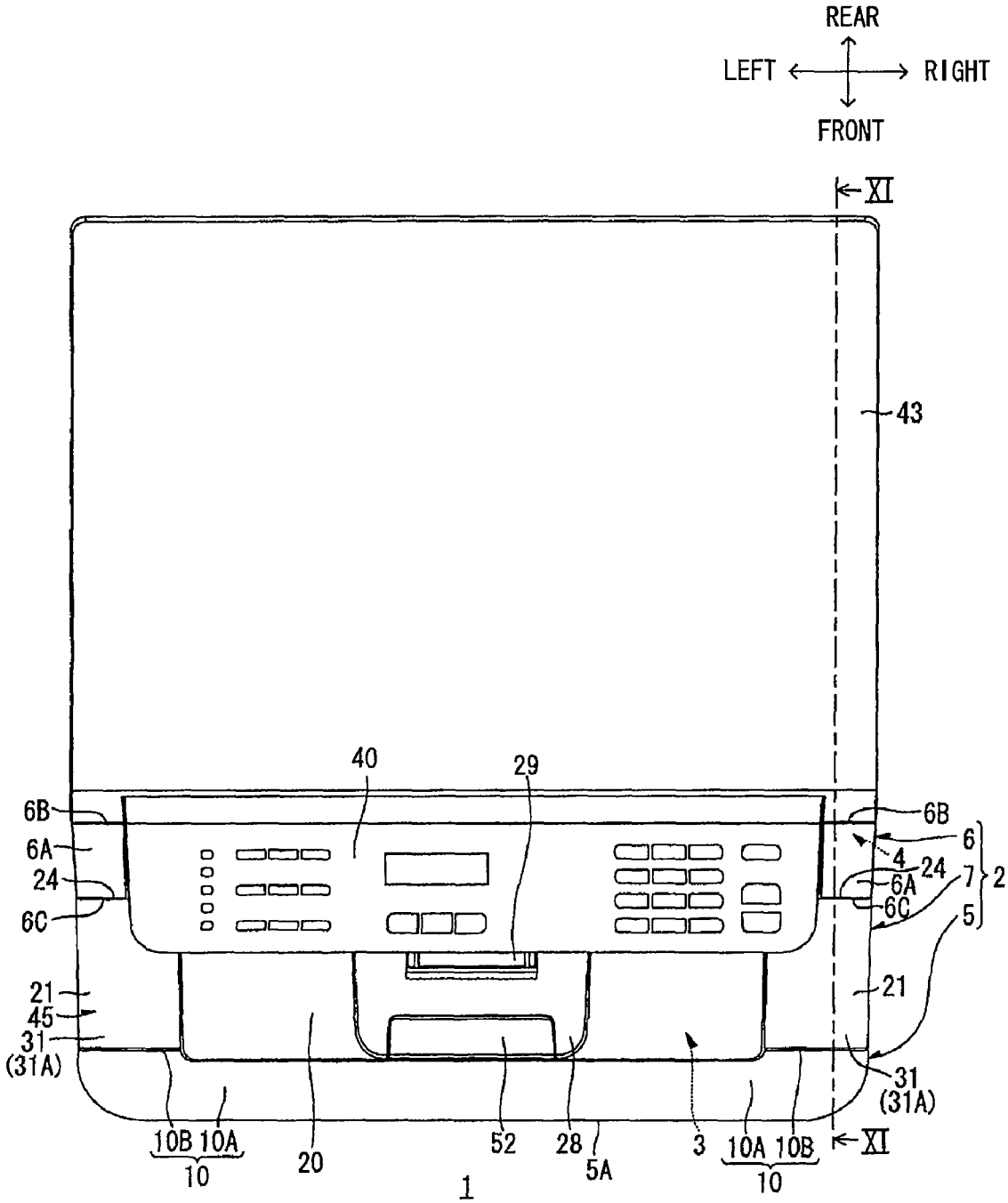
FIG. 5 is a plan view of the printer with the middle body and the upper body both closed.

As shown in FIG. 5, the grip member 28 is located to the rear of the front surface 5A. As shown in FIG. 6, the sloping surface 23B in the substantial U-shape surrounds the grip member 28. The grip member 28 has lower lateral edges 28B, each is slightly curved and sloping downward toward the front, and each is in continuous with the sloping surface 23B. The grip member 28 also has a bottom surface 28C that is located above a front end of the lower lateral edge 28B and that expands in the substantial horizontal direction. That is, the grip member 28 is located above the sloping surface 23B With this configuration, as shown in FIGS. 4 and 6, a space Y is defined between the grip member 28 and the sloping surface 23B.

An auxiliary tray 29 is disposed in a rear section of the grip member 28. The auxiliary tray 29 is in a substantial rectangular plate shape smaller than the grip member 28. The auxiliary tray 29 is supported to the grip member 28 at a front section so as to be pivotable between a lying posture indicated by a solid line in FIG. 3 and an upright posture indicated by a broken line in FIG. 3. Specifically, the auxiliary tray 29 in the lying posture is buried in the auxiliary tray 29 and lies along the upper surface 28A of the grip member 28, and the auxiliary tray 29 in the upright posture extends in a direction intersecting the upper surface 28A. An angle between the lying posture and the upright posture is equal to or greater than 90 degrees.

As indicated by broken lines in FIG. 1, if the paper sheet S is discharged while the auxiliary tray 29 is in the upright posture, then the auxiliary tray 29 supports and lifts up a leading end portion of the discharged paper sheet S, and thus the paper sheet S is supported above the grip member 28 without contacting the same.

Therefore, the paper sheet S does not hide the grip member 28 even if the paper sheet S has a long length. Thus, the user can easily access the grip member 28, and the user can grab and pull out the paper sheet S. When the auxiliary tray 29 is not needed, the user can place the auxiliary tray 29 in the lying posture so that the auxiliary tray 29 becomes flush with the grip member 28 and thus does not get in the way of user operation or the like.

The support members 21 will be described further. As shown in FIG. 3, the upper surface of each support member 21 expands in the substantial horizontal direction. A large part of a top of the support member 21 is open, exposing inside of the support member 21. Each support member 21 also has a bottom surface 30, an outer side surface 21A, and a front wall 31. The bottom surface 30 expands in the substantial horizontal direction as the upper surface 24, and is flush with a bottom surface (not shown) of the cover member 20. The outer side surfaces 21A are substantially flush with the right surface 5C and the left surface 5D (FIG. 2), respectively, of the lower body 5.

The front wall 31 inclines downward toward the front and protrudes downward beyond the bottom surface 30. The front wall 31 has a front surface 31A that inclines downward toward the front. As shown in FIG. 4, the front surface 31A is slightly concavely curved, and the grip member 28 protrudes frontward beyond the front surface 31A. As shown in FIG. 3, the front surface 31A is located above and rearward of the first part 10A of the sloping surface 10 and is in continuous with the first part 10A when the middle body 7 is closed.

As shown in FIG. 4, the middle body 7 also includes a pivot shaft 33 disposed at a lower section of the connecting member 22. The pivot shaft 33 extends in the width direction and is supported to the rear part 9C (FIG. 2) of the lower body 5. The middle body 7 is pivotable about the pivot shaft 33 between a closed position shown in FIG. 1 and an open position shown in FIG. 2 as described above.

As shown in FIG. 1, when the middle body 7 is in the closed position, the bottom surfaces 30 of the support members 21 contact the entire of the right part 9A and the left part 9B (FIG. 2), respectively, of the upper surface 9 of the lower body 5 from above. Also, a lower section of the front wall 31 of each support member 21 contacts the corresponding third part 10C of the sloping surface 10 of the lower body 5 from above. Further, a front section of the cover member 20 confronts the middle section 10BM (FIG. 2) of the sloping surface 10 of the lower body 5 from an upper rear side.

With this configuration, the outer side surfaces 21A are continuous with the right and left side surfaces 5C and 5D, respectively, of the lower body 5. Also, the front surfaces 31A of the middle body 7 and the upper surface 23 of the cover member 20 are continuous with the first part 10A of the sloping surface 10 of the lower body 5.

Grabbing the grip member 28, a user can open the middle body 7 by pivoting the middle body 7 upward about 45 degrees to the open position shown in FIG. 2. When the middle body 7 is opened in this manner, a bottom of the middle body 7 (i.e., the bottom surface of the cover member 20 and the bottom surfaces 30 of the support members 21) is separated from the upper surface 9 of the lower body 5, exposing the opening 11 (accommodating chamber 14) of the lower body 5.

In this condition, the user can perform maintenance operations on the image forming section 3 accommodated in the accommodating chamber 14 (e.g., clearing paper jam, replacing a toner cartridge of the image forming section 3). The user can close the middle body 7 by pivoting the middle body 7 downward about 45 degrees to the closed position.

The upper body 6 will be described further. As shown in FIG. 1, the upper body 6 is in a substantial rectangular plate shape having a relatively thick thickness in the vertical direction. The upper body 6 has a dimension large enough to cover nearly the entire of the top of the middle body 7 (the upper surfaces 24 of the support members 21, the upper surface of the connecting member 22, and an area surrounded by these surfaces).

The upper body 6 has a front surface 6A, a rear surface, an upper surface 6B, a bottom surface 6C, and a pair of outer side surfaces 6D. When both the upper body 6 and the middle body 7 are closed as shown in FIG. 1, the outer side surfaces 6D are substantially flush with the respective outer side surfaces 21A of the support members 21 of the middle body 7, and also with the respective surfaces 5C and 5D of the lower body 5.

The front surface 6A of the upper body 6 is inclined downward toward the front and, as shown in FIG. 4, slightly concavely curved. In FIG. 1, the front surface 6A is positioned upper-rearward of and in continuous with the front surfaces 31A of the support members 21 of the middle body 7.

The upper body 6 includes an operating portion 40 integrally formed in a middles section on the front surface 6A in the width direction. The operating portion 40 projects frontward from the front surface 6A and has a greater dimension in the width direction than in the front-to-rear direction. The operating portion 40 has a substantially-triangular cross section in a side view with a narrower thickness toward the front. More specifically, the operating portion 40 has a rear surface 40A, a bottom surface 40B, a front surface 40C, and an upper surface 40D. The rear surface 40A extends along and is connected to the front surface GA. The bottom surface 40B extends frontward from a lower front edge of the rear surface 40A in the substantial horizontal direction. The front surface 40C extends in an upper front direction from a front edge of the bottom surface 40B. The upper surface 40D extends from an upper edge of the front surface 40C in an upper rear direction to an upper rear edge of the rear surface 40A.

The upper surface 6B and the bottom surface 6C are both flat and expand in the substantial horizontal direction. The bottom surface 6C is substantially flush with the bottom surface 40B of the operating portion 40. An upper rear corner between the upper surface 40D and the rear surface 40A of the operating portion 40 is connected to a front end of the upper surface 6B.

The operating portion 40 includes a plurality of operation keys 41 and a display unit 42 disposed on the upper surface 40D. A user can control the function of the printer 1 by manipulating the operating portion 40, e.g., pressing the operation keys 41. The display unit 42 displays running status or the like of the printer 1.

The upper body 6 accommodates therein the image reading section 4 (FIG. 4), and is provided with a document holding cover 43 on the upper surface 6B. The document holding cover 43 is in a substantially rectangular plate shape having a dimension large enough to cover the entire upper surface 6B. The document holding cover 43 is pivotably supported to the upper body 6 at the rear end via a pivot shaft (not shown) extending in the width direction such that the document holding cover 43 is pivotable between a closed position shown in FIG. 1 where the document holding cover 43 lies on the upper surface 6B and an open position to expose the upper surface 6B. The document holding cover 43 can be pivoted by a user gripping a front section of the document holding cover 43. The upper body 6 and the image reading section 4 together function as an image reading device.

Magnets (not shown) are provided to the document holding cover 43 and the upper surface 6B of the upper body 6. Magnetic force between the magnets pulls the document holding cover 43 toward the upper surface 6B.

In order to make a copy of an original document, a user first opens the document holding cover 43. Then, the user places the original document onto the upper surface 6B of the upper body 6, and closes the document holding cover 43. As a result, the original document is held by the document holding cover 43 from the above. Next, the user operates the operation keys 41 following a predetermined procedure. As a result, the image reading section 4 reads images from the original document, and the image forming section 3 generates image data based on the read images and forms images on the paper sheet S based on the image data.

As shown in FIG. 4, the grip member 28 protrudes further frontward than the operating portion 40. Because the image reading section 4 is accommodated in the upper body 6, the grip member 28 is located at a position further frontward than the image reading section 4. Thus, the user can see the grip member 28 when looks at the operating portion 40, so the user can easily recognize and access the grip member 28.

Also, because the grip member 28 is protruding to a position frontward of the upper body 6 accommodating the image reading section 4, it is possible to prevent a hand of the user holding the grip member 28 from bumping the upper body 6 when pivots the middle body 7 to open or close.

The upper body 6 is supported to the middle body 7 (the support members 21 and the connecting member 22) so as to be pivotable about a pivot shaft 44 shown in FIG. 4 that is disposed at a lower rear section of the upper body 6 and that extends in the width direction. With this configuration, the upper body 6 can pivot between the closed position shown in FIG. 1 and the open position shown in FIG. 3 as described above about the pivot shaft 44. It should be noted that the upper body 6 may be pivotably supported to the lower body 5 instead.

As shown in FIG. 1, when the upper body 6 and the middle body 7 are both closed, the bottom surface 6C of the upper body 6 contacts the entire area of the upper surfaces 24 of the support members 21 from above. Thus, the outer side surfaces 6D of the upper body 6 are in continuous with the respective outer side surfaces 21A of the support members 21 of the middle body 7, and the front surface 6A of the upper body 6 is in continuous with the front surfaces 31A of the support members 21 of the middle body 7.

That is, the front surface 6A of the upper body 6, the front surfaces 31A of the support members 21 of the middle body 7, and the first part 10A of the sloping surface 10 of the lower body 5 continue in this order from the top to the bottom. The front surface 6A, the front surfaces 31A, and the first part 10A together form the sloping surface 45 shown in FIG. 4 that extends from the upper edge of the front surface 5A of the lower body 5 to the front edge of the upper surface 6B of the upper body 6.

In this condition, the support members 21 support the upper body 6 from below, and a slot 46 is defined in the center of the sloping surface 45. The slot 46 has a substantial rectangular shape in a front view. More specifically, the top and bottom of the slot 46 are defined by the front edge of the bottom surface 6C of the upper body 6 and the front edge of the cover member 20 of the middle body 7, respectively, and the right and the left of the slot 46 are defined by the support members 21. The slot 46 is in fluid communication with the space 32 from the front, so that a user can reach and take out the paper sheet S in the space 32 through the slot 46.

In order to open the upper body 6, a user pivots the upper body 6 upward about 30 degrees to the open position shown in FIG. 3. When the upper body 6 is opened, the bottom surface 6C of the upper body 6 is separated from the top of the middle body 7, exposing the space 32. In this condition, the user can reach inside the space 32 from the above as well as from the front. Thus, the user can easily take out a stack of large number of paper sheets S on the support surface 23A or a short paper sheet S in an inner section (rear section) of the space 32.

Figure 11:
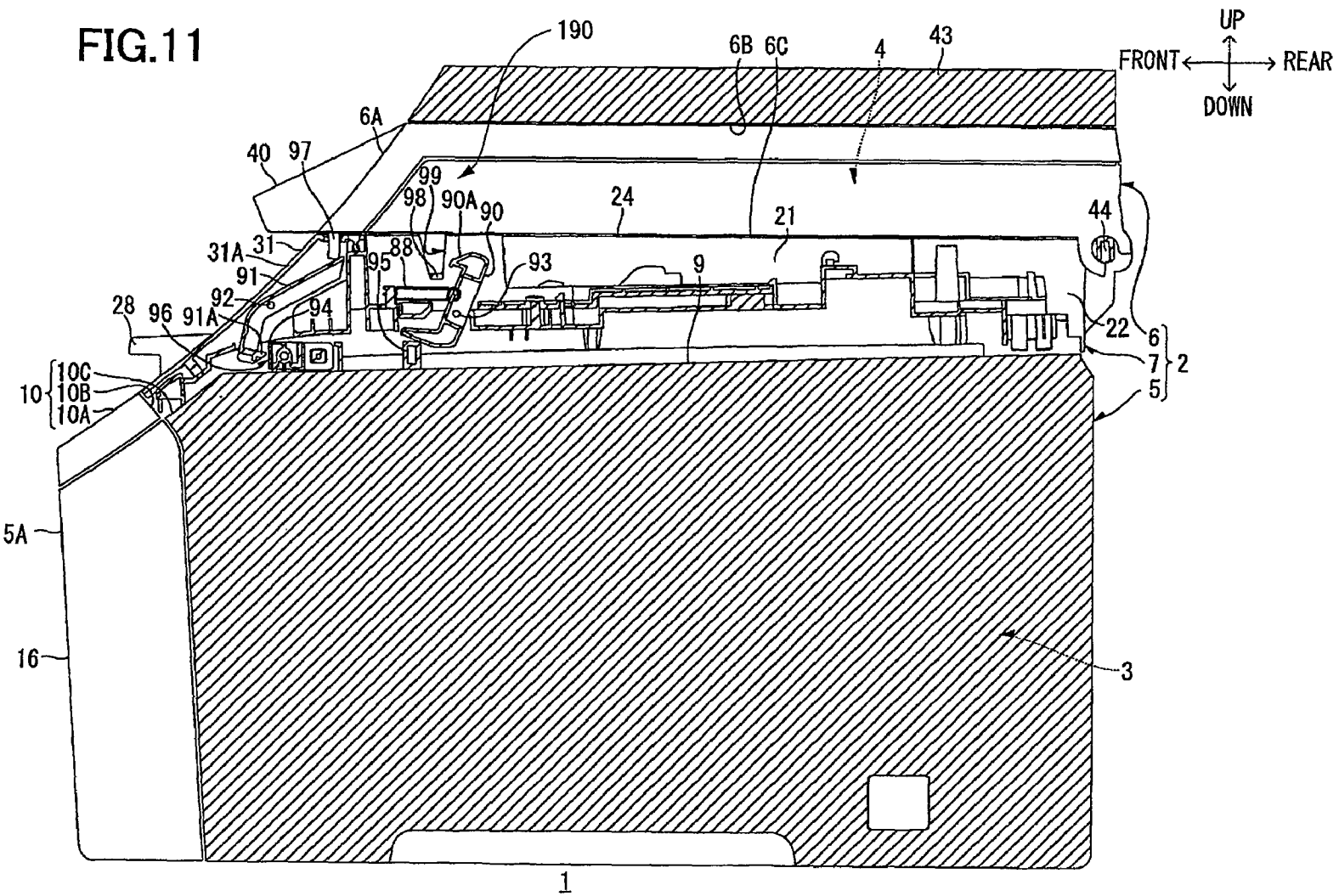
FIG. 11 is a cross-sectional view taken along a line XI-XI in FIG. 5.

The printer 1 further includes a first lock mechanism 160 shown in FIG. 6 and a second lock mechanism 190 shown in FIG. 11. The first lock mechanism 160 will be described next. As shown in FIG. 6, the grip member 28 is formed with a pair of protruding parts 28P protruding frontward from lateral sections of the grip member 28, and each of the protruding parts 28P has a front surface 28Q. The first lock mechanism 160 includes the knob 52 disposed between the protruding parts 28P. The knob 52 has a narrow plate shape extending in the width direction and has the same thickness as the grip member 28. The knob 52 has an upper surface 52A substantially flush with the upper surface 28A and a front surface 52B substantially flush with the front surface 28Q.

Figure 7:
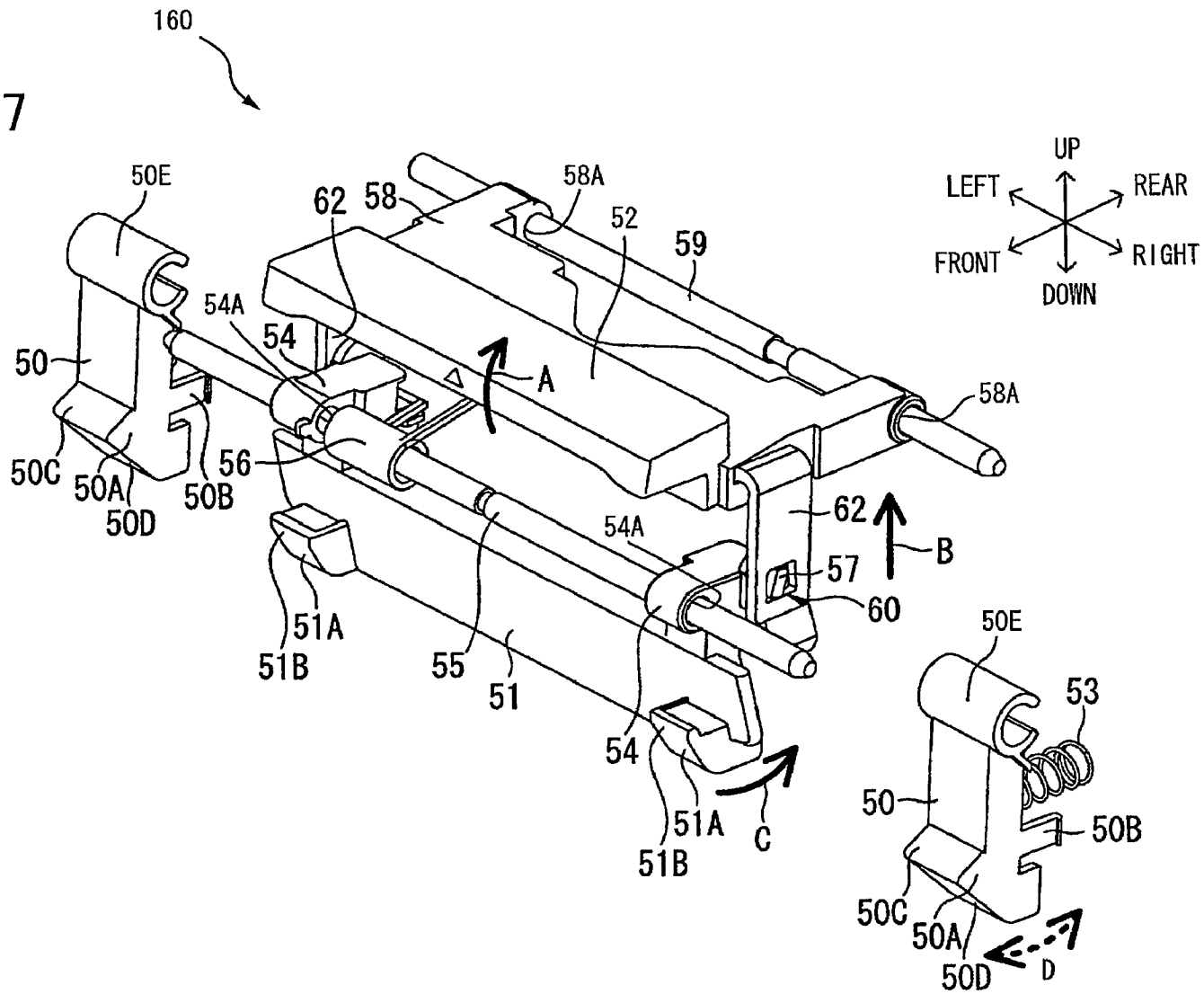
FIG. 7 is an exploded perspective view showing internal structure of the front section of the cover member of the middle body.
Figure 8:
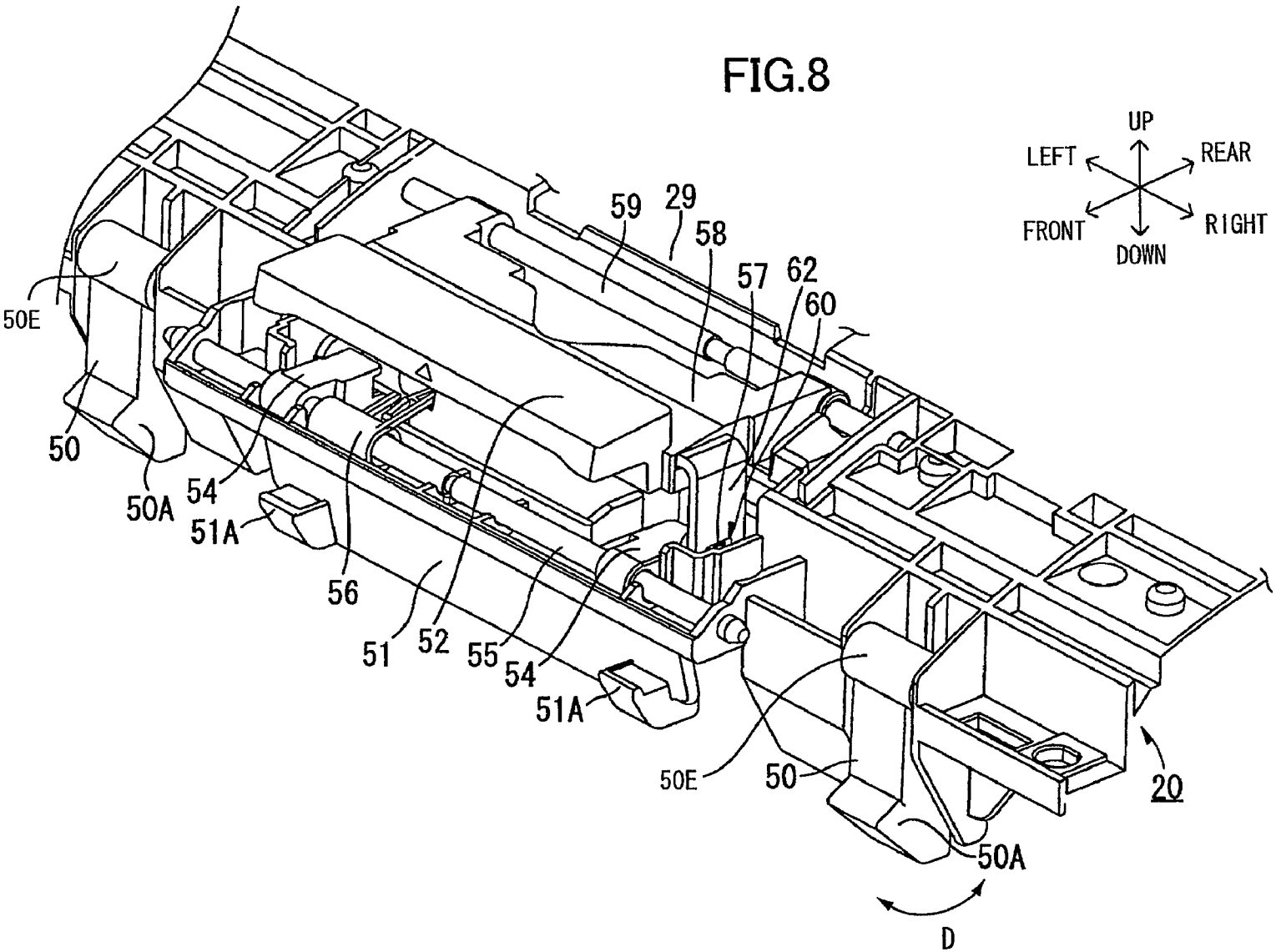
FIG. 8 is perspective view showing the internal structure of the front section of the cover member.

As shown in FIG. 7, the knob 52 is integrally formed with a plate 58 having a thin thickness in the vertical direction at a lower rear section. The plate 58 has a substantial-U shape in a plan view with an opening facing rearward. The plate 58 is formed with a pair of through holes 58A at rear sections for receiving a shaft 59 extending in the width direction. As shown in FIG. 8, the shaft 59 is supported to the cover member 20. In this manner, the knob 52 is supported to the cover member 20 via the shaft 59 so as to be pivotable about the shaft 59.

Figure 9:
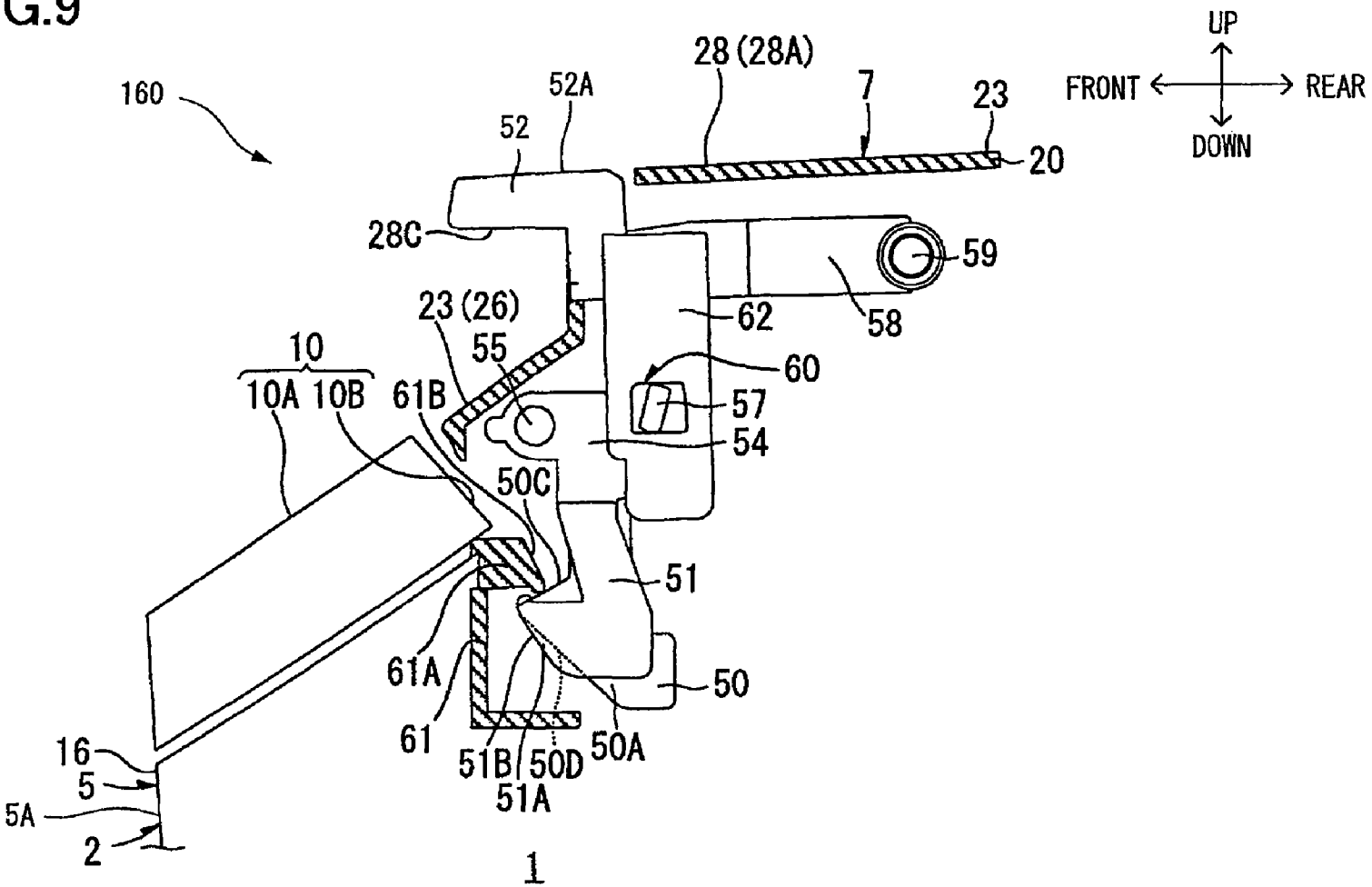
FIG. 9 is a cross-sectional right-side view showing the front section of the cover member and surrounding components with the middle body locked in a closed position.
Figure 10:
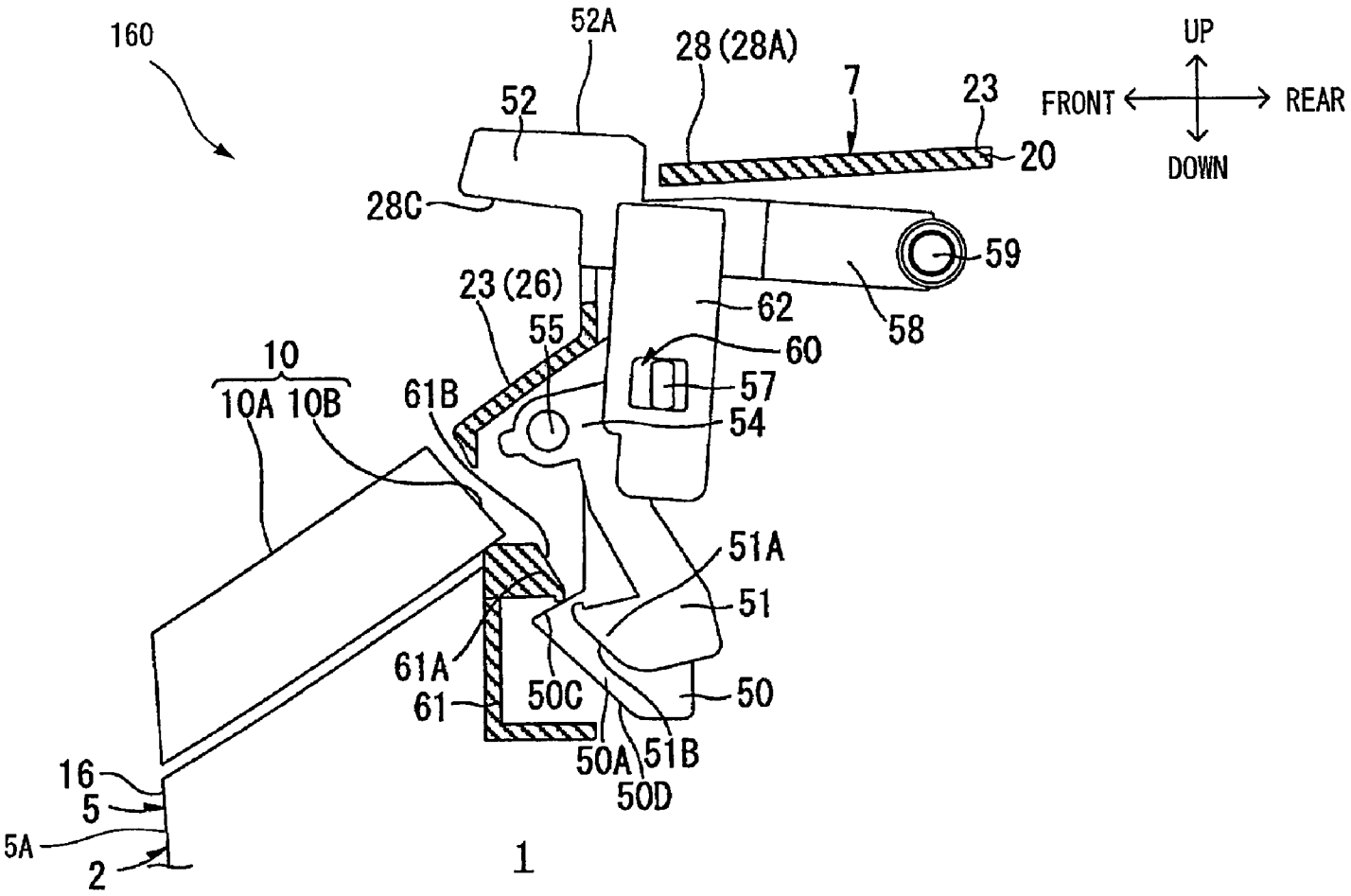
FIG. 10 is a cross-sectional right-side view showing the front section of the cover member and the surrounding components with the middle body unlocked in the closed position.

More specifically, the knob 52 is pivotable from a lower position shown in FIG. 9 to a higher position shown in FIG. 10 in the clockwise direction in the right-side view. In the lower position shown in FIG. 9, the upper surface 52A of the knob 52 is substantially flush with the upper surface 28A of the grip member 28. On the other hand, in the higher position shown in FIG. 10, the upper surface 52A of the knob 52 is at a higher position than the upper surface 28A of the grip member 28.

As shown in FIG. 6, the first lock mechanism 160 also includes a pair of engaging members 50 and a lock member 51 disposed on a front section of a bottom surface of the cover member 20. The engaging members 50 are arrayed in the width direction with a space therebetween. The lock member 51 is positioned between the engaging members 50 at the same position as the grip member 28 with respect to the width direction.

As shown in FIG. 7, each of the engaging members 50 is longer in the vertical direction than in the width direction and is integrally formed with a claw 50A at the bottom, a ring portion 50E at the top, and a bending member 50B at the rear. The ring portion 50E has a substantially-C shaped cross section with an opening facing rearward. The bending member 50B is located at a position slightly higher than the claw 50A. The bending member 50B extends rearward and then bends to the right. Each claw 50A has an upper surface 50C that inclines upward toward the rear and a lower surface 50D that inclines downward toward the rear.

As shown in FIG. 8, each engaging member 50 is supported to the cover member 20 at the ring portion 50E so as to be pivotable in a direction D. As shown in FIG. 7, a coil spring 53 is disposed to the rear of each engaging member 50 for urging the engaging member 50 toward the front. The bending member 50B is for regulating the pivoting range of the engaging member 50. That is, the bending member 50B catches on the cover member 20 when the engaging member 50 reaches a predetermined position, thereby preventing the engaging member 50 from pivoting frontward beyond a predetermined position.

The lock member 51 is in a plate shape elongated in the width direction and has a relatively thin thickness in the front-to-rear direction. The lock member 51 is integrally formed at the right and left sections with a pair of claws 51A protruding frontward from the lower front section. Each of the claws 51A has a lower surface 51B that is inclined downward toward the rear. The lock member 51 is also formed integrally with a pair of protruding parts 54. The protruding parts 54 extend upward from the top of the right and left sections of the lock member 51 and then bend rearward. Each of the protruding parts 54 is formed with a through hole 54A at a front edge of the portion extending rearward, for receiving a shaft 55 extending in the width direction. As shown in FIG. 8, the shaft 55 is supported to the cover member 20 at a position lower than the knob 52. With this configuration, the lock member 51 is supported to the cover member 20 via the shaft 55 so as to be pivotable about the shaft 55.

As shown in FIG. 7, a spring 56 is disposed around the shaft 55 for urging the lock member 51 frontward (in a clockwise direction in a right-side view). Also, each of the protruding parts 54 is integrally formed with a protrusion 57 at a position rearward of the through hole 54A. The protrusion 57 protrudes outward in the width direction.

As shown in FIG. 7, a pair of connection pieces 62 are disposed one on either lateral end of the plate 58 near the front. Each of the connection pieces 62 has a thin thickness in the width direction and is relatively long in the vertical direction. Each connection piece 62 is formed with a through hole 60 at a lower section. The through hole 60 penetrates through the connection piece 62 in the width direction. The protrusion 57 of the protruding part 54 is inserted to the corresponding through hole 60 from the inner side, thereby connecting the lock member 51 to the knob 52.

When the knob 52 is pivoted from the lower position shown in FIG. 9 to the higher position shown in FIG. 10 by a user, then the protrusions 57 within the through holes 60 are lifted up by the connection pieces 62 in a direction indicated by an arrow B in FIG. 7.

As a result, the lock member 51 pivots in a direction indicated by an arrow C in FIG. 7 about the shaft 55 against the urging force of the spring 56, so that the claw 51A of each lock member 51 moves rearward from a position shown in FIG. 9 to a position shown in FIG. 10. If the user releases the knob 52 in this condition, the lock member 51 is returned to an original position by the urging force of the spring 56, so the knob 52 also is returned to its original position shown in FIG. 9.

As shown in FIG. 9, the lower body 5 includes a front wall 16 having the front surface 5A and an inner surface that is integrally formed with an engaged member 61 at an upper middle section below the second part 10B of the sloping surface 10. The engaged member 61 has a substantially-U-shaped cross section in a side view having an opening facing rearward. The engaged member 61 is elongated in the width direction and has an upper section 61A. The upper section 61A has a rear surface 61B inclined downward toward the rear.

As shown in FIG. 9, when the middle body 7 is in the closed state and the knob 52 is in the original position, the claws 50A of the engaging members 50 and the claws 51A of the lock member 51 are in engagement with the upper section 61A of the engaged member 61, i.e., the lower body 5. Because the claws 51A of the lock member 51 project in the upper front direction and are sharper than the claws 50A, the claws 51A are firmly engaged with the engaged member 61. This engagement fixes the middle body 7 to the lower body 5 and thus prevents the middle body 7 from pivoting about the pivot shaft 33 (FIG. 4). In this manner, the lock member 51 locks the middle body 7 in the closed state. The engaging members 50 assist the lock member 51 in locking the middle body 7.

In order to open the middle body 7, the user lifts up the knob 52 of the grip member 28. As a result, the knob 52 pivots upward, and thus the claws 51A of the lock member 51 move rearward from the position shown in FIG. 9 to the position shown in FIG. 10 where the claws 51A are out of engagement with the engaged member 61. In other words, the operation to move the middle body 7 from the closed position toward the open position moves the lock member 51 from a locking position shown in FIG. 9 to an unlocking position shown in FIG. 10, releasing the lock member 51 from a locking state. In this condition, the claws 50A of the engaging members 50 remain in engagement with the upper section 61A of the engaged member 61. Therefore, the middle body 7 (the cover member 20) is still locked even if the lock member 51 is in the unlocked position as long as the claws 50A of the engaging members 50 remain in engagement with the upper section 61A of the engaged member 61.

When the user moves the grip member 28 further upward, then the claws 50A of the engaging members 50 move rearward against the urging force of the coil springs 53 (FIG. 7) because the upper surfaces 50C of the claws 50A that contact the upper section 61A incline upward toward the rear as described above. As a result, the claws 50A are disengaged from the engaged member 61.

Thus, the claws 50A of the engaging members 50 and the claws 51A of the lock member 51 are all out of engagement with the engaged member 61, enabling the middle body 7 to move upward relative to the lower body 5. Therefore, lifting up the grip member 28 moves the middle body 7 to the open position shown in FIG. 2.

Because the middle body 7 (the cover member 20) does not open in a state where only the locking state of the lock member 51 is released as long as the engaging members 50 are in the locking state, it is possible to prevent the middle body 7 from being opened unintentionally by a user accidentally bumping the grip member 28 (the knob 52).

Because the simple operation to open the middle body 7 disengages both the engaging members 50 and the lock member 51 from the lower body 5, it is unnecessary to perform a separate operation to disengage the engaging members 50 or the lock member 51 from the lower body 5, enhancing the operability. Also, because the grip member 28 is located in the front of the cover member 20, a user can easily access the grip member 28. Thus, the operability for opening or closing the cover member 20 is enhanced. Because the grip member 28 protrudes frontward, the user can further easily access the grip member 28.

Because the lock member 51 maintains the cover member 20 (the middle body 7) closed as described above, the cover member 20 can be prevented from being opened accidentally during image forming operations, for example.

On the other hand, when the middle body 7 is moved from the open position toward the closed position, the lower surfaces 50D of the claws 50A and the lower surfaces 51B of the claws 51A abut the rear surface 61B of the engaged member 61 as lowered. Because the lower surfaces 50D of the claws 50A, the lower surfaces 51B of the claws 51A, and the rear surface 61B of the engaged member 61 are all inclined downward toward the rear as described above, the claws 50A and 51A are moved diagonally downward and rearward along the rear surface 61B thereafter.

As the middle body 7 reaches the closed position, the claws 50A and 51A are past a lower rear edge of the upper section 61A of the engaged member 61 and moved frontward by the urging force of the springs 53 and 56. Then, the claws 50A and 51A engage with the upper section 61A of the engaged member 61.

Because the grip member 28 is located in the middle of the cover member 20 with respect to the width direction, the user can pivot the middle body 7 by holding the grip member 28 without feeling sense of discomfort.

As described above, the space Y shown in FIG. 4 is defined between the grip member 28 and the sloping surface 23B. Thus, the user can reliably hold the grip member 28 by inserting fingers into the space Y. Also, the grip member 28 protruding frontward is eye-catching, facilitating the user to grab the grip member 28 when opening or closing the middle body 7. Because the grip member 28 protrudes frontward beyond the support members 21, the user can easily access the grip member 28.

As described above, the width of the grip member 28 is smaller than the minimum width of the paper sheet S. Thus, even if a paper sheet S is discharged on the grip member 28 as indicated by a dotted line in FIG. 3, the user can easily pull out the paper sheet S by holding a portion of the paper sheet S running off the edge of the grip member 28.

Because the grip member 28 is located rearward of the front surface 5A, the user will not bump the grip member 28 when walking past the printer 1.

Because the front surfaces 31A of the support members 21 on both lateral sides of the space 32 are sloping downward toward the front, a user will have less feeling of pressure when pull out the paper sheet S, compared with the case where the support members 21 have front surfaces extending in the vertical direction.

Next, the second lock mechanism 190 will be described. As shown in FIG. 11, the second lock mechanism 190 includes a first lock lever 90 and a second lock lever 91 disposed in each of the support members 21 of the middle body 7 (see FIG. 3). The first lock lever 90 extends upward toward the rear in the state shown in FIG. 11. The first lock lever 90 is integrally formed at the top with a claw 90A that protrudes frontward. The first lock lever 90 has a lower end that is bent frontward.

The first lock lever 90 is pivotable about a first support shaft 93 that is inserted through the first lock lever 90 at a position between the claw 90A and the lower end. The first support shaft 93 extends in the width direction and is supported to the support member 21. The first lock lever 90 is urged by a spring 88 in a counterclockwise direction in the right side view.

The second lock lever 91 is located frontward of the first lock lever 90. The second lock lever 91 extends upward and is bent diagonally upward and rearward. The second lock lever 91 is integrally formed at the bottom with a claw 91A that protrudes rearward. The second lock lever 91 is pivotable about a second support shaft 92 that is inserted through the second lock lever 91 at a bent section. The second support shaft 92 extends in the width direction, and is supported to the support member 21. The second lock lever 91 is urged by an urging member (not shown) in the counterclockwise direction in the right side view.

The second lock mechanism 190 also includes a pair of second engaging members 94 and a pair of first protruding members 95 on the upper surface 9 of the lower body 5 (see FIG. 2). Each of the second engaging members 94 and the first protruding members 95 protrudes upward. In a condition shown in FIG. 11 (when both the upper body 6 and the middle body 7 are closed), the second engaging member 94 is located rearward of the claw 91A of the second lock lever 91. The second engaging member 94 is in a plate shape with a thin thickness in the front-to-rear direction, and is formed with a through hole 96 penetrating the second engaging member 94 in the front-to-rear direction. The first protruding member 95 is disposed rearward of the second engaging member 94 with a predetermined distance therebetween.

The second lock mechanism 190 further includes a pair of second protruding members 97 and a pair of first engaging members 98 on the bottom surface 6C of the upper body 6 (only one of each is shown in FIG. 11). In the condition shown in FIG. 11, each second protruding member 97 protrudes downward and confronts an upper end of the second lock lever 91. Also, each first engaging member 98 is positioned rearward of the second protruding member 97 with a predetermined distance therebetween and frontward of the claw 90A of the first lock lever 90. Each first engaging member 98 protrudes downward also. The first engaging member 98 has a thin thickness in the front-to-rear direction, and is formed with a through hole 99 penetrating the first engaging member 98 in the front-to-rear direction.

In the condition shown in FIG. 11, the second engaging members 94 and the first protruding members 95 on the upper surface 9 of the lower body 5 extend upward to a position within the support member 21, and the second protruding members 97 and the first engaging members 98 on the bottom surface 6C of the upper body 6 extend downward to a position within the support members 21.

In this condition, each first protruding member 95 contacts the bottom of the first lock lever 90 from below, thereby positioning the first lock lever 90 with the claw 90A located rearward of the through hole 99 of the first engaging member 98 with a space therebetween. In other words, the first protruding member 95 prevents the pivotal movement of the first lock lever 90 in the counterclockwise direction in the right-side view. On the other hand, the second protruding member 97 contacts the upper section of the second lock lever 91 from above, thereby positioning the second lock lever 91 with the claw 91A being located frontward of the through hole 96 of the second engaging member 94 with a space therebetween. In other words, the second protruding member 97 prevents the pivotal movement of the second lock lever 91 in the counterclockwise direction in the right-side view.

Figure 12:
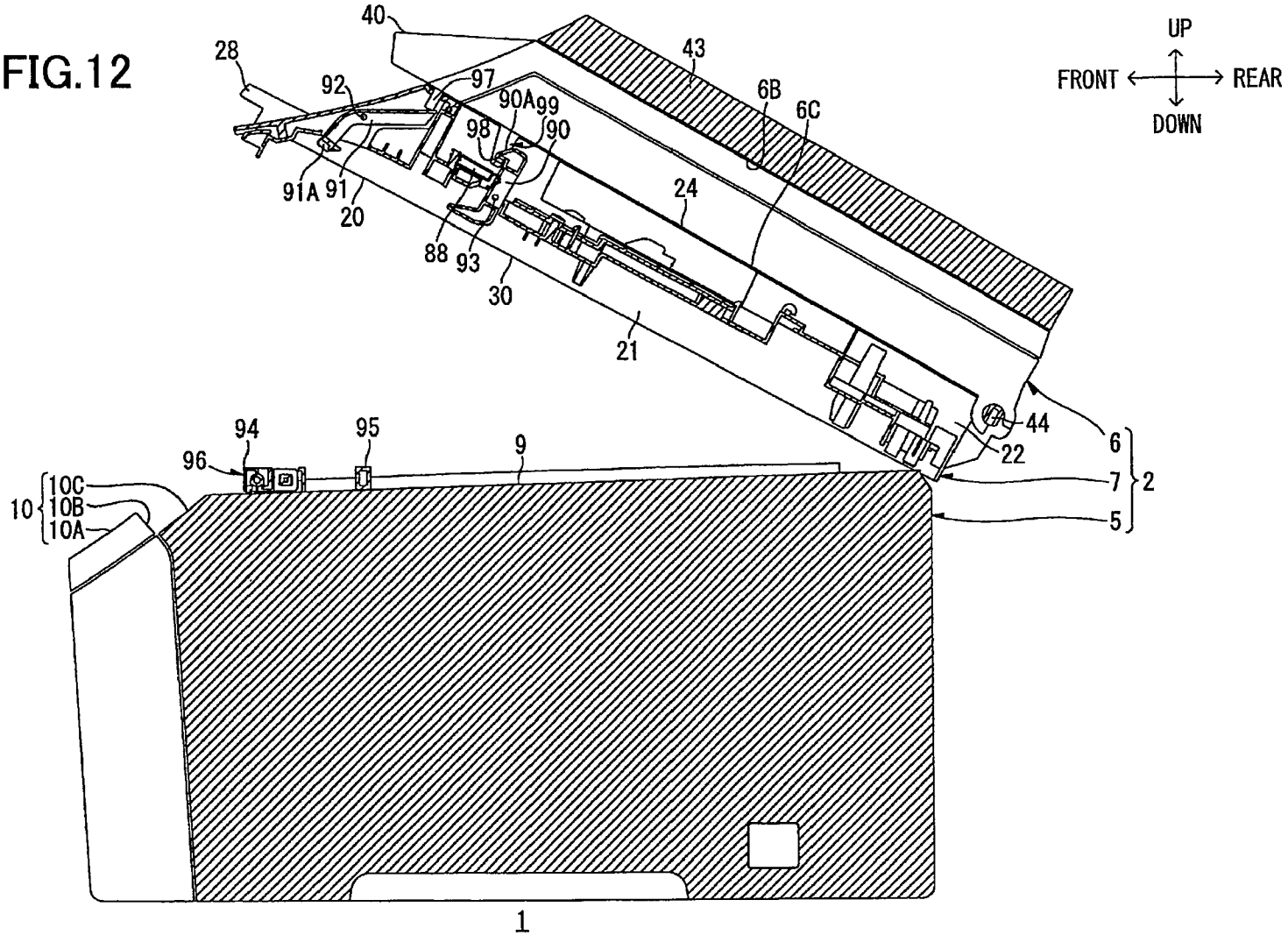
FIG. 12 is a cross-sectional view corresponding to FIG. 11 with the middle body open.

When the middle body 7 is opened as shown in FIG. 12, then the bottom surface 30 of the support member 21 of the middle body 7 is separated from the upper surface 9 of the lower body 5, and thus the bottom of the first lock lever 90 is separated from the first protruding member 95. As a result, the first protruding member 95 no longer prevents the pivotal movement of the first lock lever 90, so the first lock lever 90 is pivoted in the counterclockwise direction by the urging force of the spring 88 to a position shown in FIG. 12. As a result, the claw 90A of the first lock lever 90 is moved frontward into the through hole 99 to engage with the first engaging member 98, securing the upper body 6 to the support member 21 of the middle body 7.

That is, when the middle body 7 is open, the claw 90A of the first lock lever 90 of the middle body 7 engages with the first engaging member 98 of the upper body 6 so as to secure the upper body 6 to the middle body 7. Therefore, the upper body 6 can move with the middle body 7 as a unit while closed with respect to the middle body 7. This configuration prevents the upper body 6 from moving with respect to the middle body 7 when the middle body 7 is moved with respect to the lower body 5, which makes the printer 1 off-balance.

Figure 13:
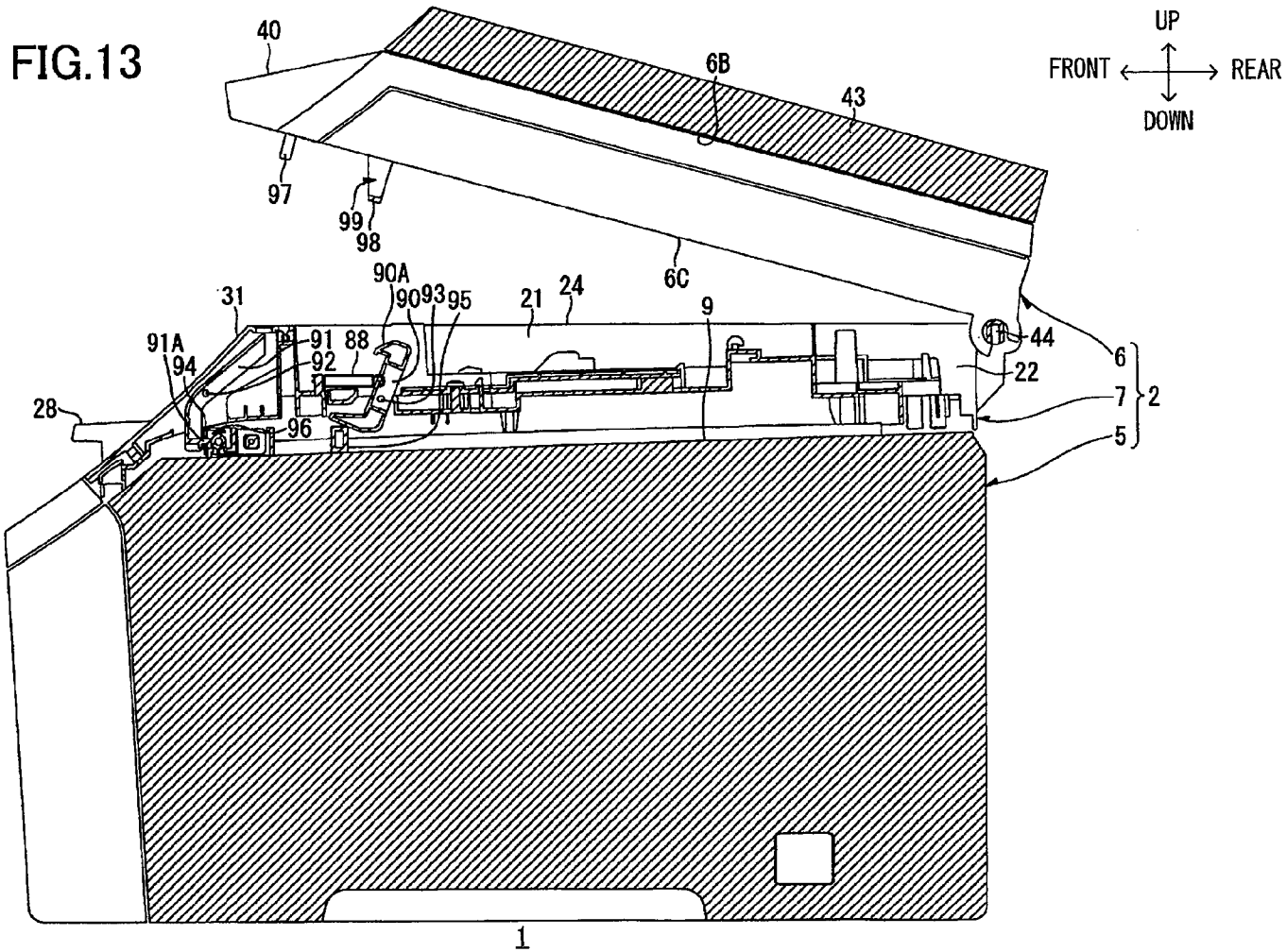
FIG. 13 is a cross-sectional view corresponding to FIG. 11 with the upper body open.

On the other hand, when the upper body 6 is opened as shown in FIG. 13 while the middle body 7 remains closed, the bottom surface 6C of the upper body 6 is separated from the upper surface 24 of the middle body 7, and thus the second protruding member 97 is separated from the upper section of the second lock lever 91. As a result, the second protruding member 97 no longer prevents the pivotal movement of the second lock lever 91, so the second lock lever 91 is pivoted in the counterclockwise direction to a position shown in FIG. 13. As a result, the claw 91A of the second lock lever 91 moves rearward into the through hole 96 of the second engaging member 94 to engage with the second engaging member 94, securing the support member 21 of the middle body 7 to the lower body 5.

That is, when the upper body 6 is open, the claw 91A of the second lock lever 91 provided to the middle body 7 engages with the second engaging member 94 provided to the lower body 5 so as to secure the middle body 7 (the support member 21) to the lower body 5. Therefore, the middle body 7 stays closed even when the upper body 6 is pivoted open. Also, because the lock member 51 maintains the middle body 7 closed when the middle body 7 is closed as described above (FIG. 9), the closed condition of the middle body 7 is maintained even if the upper body 6 is pivoted open. This configuration prevents the middle body 7 from moving with respect to the lower body 5 when the upper body 6 is moved with respect to the middle body 7, which makes the printer 1 off balance.

Also, even when the lock member 51 is moved to the unlocking position by a user lifting up the knob 52 as described above, the claw 91A of the second lock lever 91 is in engagement with the second engaging member 94 provided to the lower body 5. Therefore, the middle body 7 is maintained closed even if the upper body 6 is pivoted open.

When both the upper body 6 and the middle body 7 are returned to the closed state as shown in FIG. 11, the claw 90A of the first lock lever 90 is disengaged from the first engaging member 98, and the claw 91A of the second lock lever 91 is disengaged from the second engaging member 94.

Although not shown in the drawings, a par of claws made of resin are disposed one at either lateral section on the bottom surface 6C of the upper body 6 for engaging with the support members 21 from above when the upper body 6 is in the closed state. This configuration prevents the upper body 6 from being pivoted upward to the open position even if the document holding cover 43 is lifted up to open. The engagement between the claws and the support members 21 are released when a force greater than a predetermined force is applied on the upper body 6 to pivot the same, and thus the user can open the upper body 6.

While the invention has been described in detail with reference to the embodiment thereof, it would be apparent to those skilled in the art that various changes and modifications may be made therein without departing from the spirit of the invention.

Figure 14:
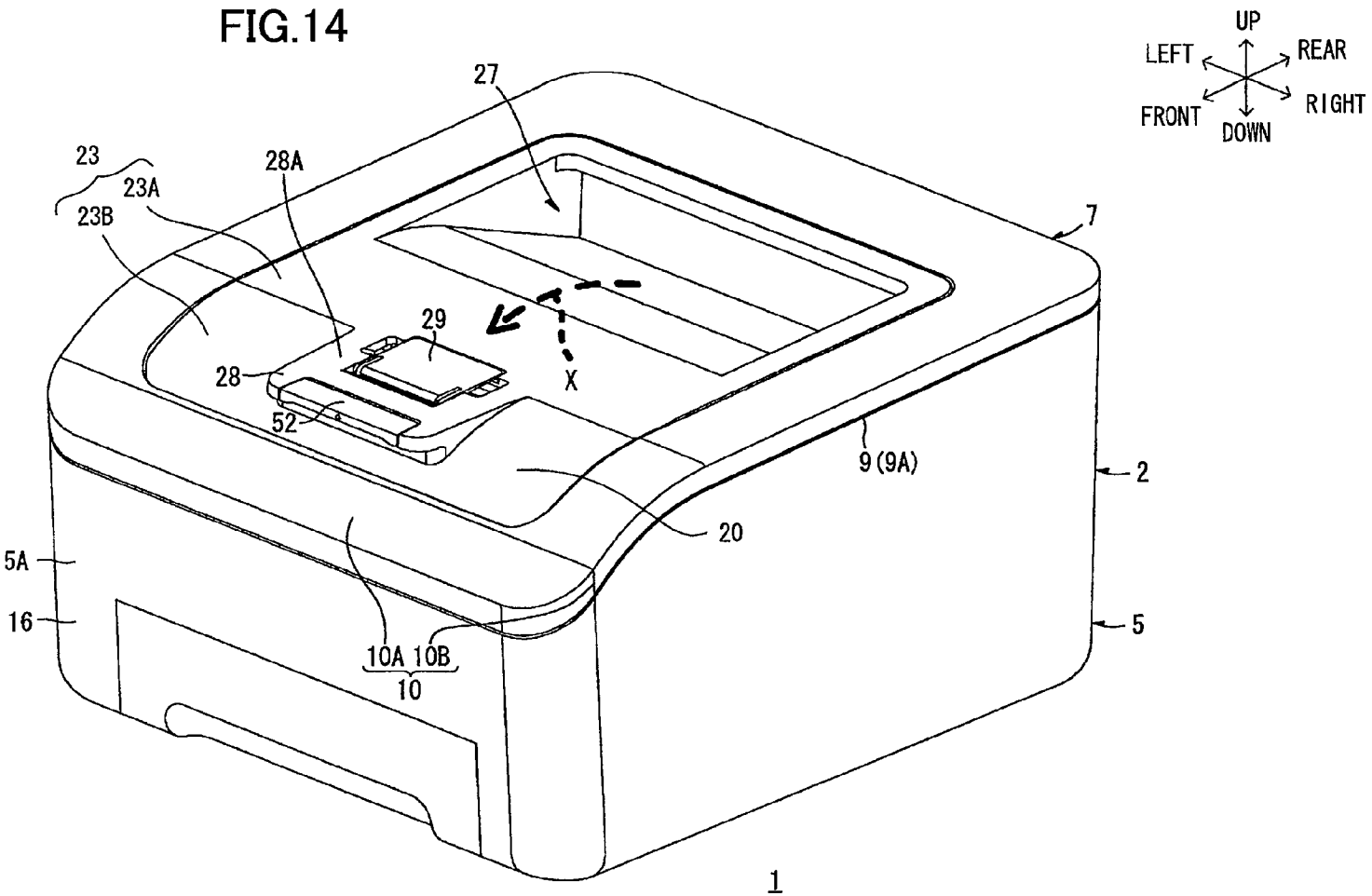
FIG. 14 is a perspective view of a printer according to a modification of the embodiment.

For example, as shown in FIG. 14, the upper body 6 and the support members 21 may be dispensed with. That is, a middle body 7' with the cover member 20 but no support members 21 is disposed to selectively expose and close the opening 11 (accommodating chamber 14) formed to the lower body 5.

What is claimed is:

1. An image forming device comprising:

a casing formed with an opening on a top side;

an image forming section disposed within the casing;

a cover member having a first side and a second side opposite from the first side, the cover member being pivotable with respect to the casing about the first side between an open position and a closed position for selectively opening and closing the opening, the first side being on an upstream side of the second side in a first direction in which a recording medium is discharged from the casing;

a lock member that is movable between a locking position and an unlocking position to selectively lock and unlock the cover member in the closed position, wherein the lock member in the locking position locks the cover member in the closed position;

a knob provided to the cover member near the second side, enabling a user to hold the knob to move the cover member between the open position and the closed position, the knob being movable from an original position toward the open position of the cover member, wherein the lock member is moved to the unlocking position as the knob is moved from the original position toward the open position, the cover member includes a grip member at which the knob is disposed, the grip member protruding in the first direction; and an auxiliary tray pivotable between a first posture and a second posture with respect to the grip member, the auxiliary tray being configured to support the recording medium discharged from the casing, wherein the grip member has an upper surface, and the auxiliary tray in the first posture lies along the upper surface of the grip member, and the auxiliary tray in the second posture is upright with respect to the upper surface of the grip member.

2. The image forming device according to claim 1, wherein the cover member has a surface on which the recording medium is discharged, and the grip member is formed continuous with the surface.

3. The image forming device according to claim 1, wherein the cover member has a sloping surface in the second side, the sloping surface extending downward toward the second side, and the grip member has an upper surface located above the sloping surface.

4. The image forming device according to claim 1, wherein the grip member is located in a middle section of the cover member with respect to a second direction perpendicular to the first direction.

5. The image forming device according to claim 1, wherein the grip member has a width in a second direction perpendicular to the first direction that is smaller than a minimum width of the recording medium that is able to be accommodated in the image forming device.

6. The image forming device according to claim 1, wherein the casing has a first surface and a second surface located on an upstream side of the first surface with respect to the first direction, and the grip member is located on an upstream side of the first surface with respect to the first direction.

7. The image forming device according to claim 1, further comprising an engaging member provided to the cover member, the engaging member engaging with the casing when the cover member is in the closed position and disengaging from the casing as the cover member moves from the closed position toward the open position.

8. An image forming device comprising:

a casing formed with an opening on a top side;

an image forming section disposed within the casing;

a cover member having a first side and a second side opposite from the first side, the cover member being pivotable with respect to the casing about the first side between an open position and a closed position for selectively opening and closing the opening, the first side being on an upstream side of the second side in a first direction in which a recording medium is discharged from the casing;

a lock member that selectively locks and unlocks the cover member in the closed position; and a knob provided to the cover member near the second side, enabling a user to hold the knob to move the cover member between the open position and the closed position, the knob being pivotable from an original position toward the open position of the cover member, wherein a locking state of the lock member is released in association with a movement of the knob from the original position toward the open position of the cover member, and the cover member includes a grip member at which the knob is disposed, the grip member protruding toward the downstream side in the first direction beyond the image reading device; and an auxiliary tray pivotable between a first posture and a second posture with respect to the grip member, the auxiliary tray being configured to support the recording medium discharged from the casing, wherein the grip member has an upper surface, and the auxiliary tray in the first posture lies along the upper surface of the grip member, and the auxiliary tray in the second posture is upright with respect to the upper surface of the grip member.

9. The image forming device according to claim 8, further comprising an engaging member provided to the cover member, the engaging member engaging with the casing when the cover member is in the closed position and disengaging from the casing as the cover member moves from the closed position toward the open position.

10. The image forming device according to claim 8, further comprising:

an image reading device capable of reading images on an original, the image reading device being disposed above the casing;

a support member disposed between the image reading device and the casing, the support member supporting the image reading device from below and defining a space at a position between the casing and the image reading device, into which the recording medium is discharged.

11. The image forming device according to claim 10, wherein the support member includes a pair of members disposed to sandwich the space therebetween, and each of the members has a surface that extends downward toward the downstream side in the first direction.

12. The image forming device according to claim 10, wherein the grip member protrudes toward the downstream side in the first direction beyond the support member.

13. The image forming device according to claim 10, further comprising an operating unit that accepts user's input, the operating unit being disposed on the image reading device in a downstream side in the first direction, wherein the grip member protrudes toward the downstream side in the first direction beyond the operating unit.

14. The image forming device according to claim 10, wherein the support member is integrally formed with the cover member, and the image reading device is supported to one of the casing and the support member so as to be pivotable about an upstream end in the first direction.

15. The image forming device according to claim 14, further comprising:

a first securing member that secures the image reading device to the support member when the cover member is open; and a second securing member that secures the support member to the casing when the image reading device is open.

16. An image forming device comprising:

a casing formed with an opening on a top side;

an image forming section disposed within the casing;

a cover member having a first side and a second side opposite from the first side, the cover member being pivotable with respect to the casing about the first side between an open position and a closed position for selectively opening and closing the opening, the first side being on an upstream side of the second side in a direction in which a recording medium is discharged from the casing;

a lock member that is movable between a locking position and an unlocking position to selectively lock and unlock the cover member in the closed position, wherein the lock member in the locking position locks the cover member in the closed position;

an engaging member that is provided to the cover member and is configured to be engaged with the casing when the cover member is in the closed position;

an urging member configured to urge the engaging member to engage the casing when the cover member is in the closed position; and a knob provided to the cover member near the second side, and enabling a user to hold the knob to move the cover member between the open position and the closed position, the knob being movable from an original position toward the open position of the cover member, wherein the lock member is moved to the unlocking position as the knob is moved from the original position toward the open position, and the engaging member is disengaged from the casing against an urging force of the urging member as the cover member is pivoted from the closed position toward the open position.

* * * * *